US009579716B2

(12) United States Patent
Nakata et al.

(10) Patent No.: US 9,579,716 B2
(45) Date of Patent: Feb. 28, 2017

(54) MOLDING APPARATUS, PRODUCTION APPARATUS OF SEMI-SOLIDIFIED METAL, PRODUCTION METHOD OF SEMI-SOLIDIFIED METAL, AND MOLDING METHOD

(71) Applicant: Toshiba Kikai Kabushiki Kaisha, Chiyoda-ku, Tokyo (JP)

(72) Inventors: Koei Nakata, Tokyo (JP); Satoru Aida, Zama (JP); Satoshi Tomioka, Zama (JP)

(73) Assignee: TOSHIBA KIKAI KABUSHIKAI KAISHA, Tokyo (JP)

( * ) Notice: Subject to any disclaimer, the term of this patent is extended or adjusted under 35 U.S.C. 154(b) by 0 days.

(21) Appl. No.: 14/513,052

(22) Filed: Oct. 13, 2014

(65) Prior Publication Data

US 2015/0101775 A1 Apr. 16, 2015

(30) Foreign Application Priority Data

Oct. 11, 2013 (JP) ..... 2013-214110

(51) Int. Cl.
*B22D 17/00* (2006.01)
*B22D 17/22* (2006.01)
(Continued)

(52) U.S. Cl.
CPC ..... *B22D 17/007* (2013.01); *B22D 17/10* (2013.01); *B22D 17/203* (2013.01); *B22D 17/22* (2013.01);
(Continued)

(58) Field of Classification Search
CPC ..... B22D 17/00; B22D 17/007; B22D 17/22; B22D 17/20; B22D 17/2218; B22D 17/203; B22D 35/06; B22D 41/005
See application file for complete search history.

(56) References Cited

U.S. PATENT DOCUMENTS 4,583,579 A * 4/1986 Miki ..... B22D 17/32 164/113
4,598,762 A * 7/1986 Glas ..... B22D 17/203 164/312
(Continued)

FOREIGN PATENT DOCUMENTS

CN 101279362 10/2008
CN 202239521 5/2012
(Continued)

OTHER PUBLICATIONS

English Language Abstract and Translation for JP 2006-334665 published Dec. 14, 2006.
(Continued)

*Primary Examiner* — Kevin P Kerns
*Assistant Examiner* — Steven Ha
(74) *Attorney, Agent, or Firm* — DLA Piper LLP US

(57) ABSTRACT

An production apparatus of a semi-solidified metal has a vessel and a cooling device. The vessel into which a liquid-state metal material M is poured has a hollow member which is opened in up and down directions, and a bottom member which can close the lower opening of the hollow member and can be separated from the hollow member. The cooling device can cool the bottom member more than the hollow member.

10 Claims, 12 Drawing Sheets

(51) Int. Cl.

| | |
|---|---|
| ***B22D 17/20*** | (2006.01) |
| ***B22D 41/00*** | (2006.01) |
| ***B22D 45/00*** | (2006.01) |
| ***B22D 17/10*** | (2006.01) |

(52) U.S. Cl.
CPC ..... *B22D 17/2218* (2013.01); *B22D 41/00* (2013.01); *B22D 45/00* (2013.01)

(56) References Cited

U.S. PATENT DOCUMENTS

| | | | | |
|---|---|---|---|---|
| 5,399,017 | A * | 3/1995 | Droege | 374/7 |
| 5,522,448 | A * | 6/1996 | Righi | B22D 17/2218 164/122 |
| 5,865,238 | A * | 2/1999 | Carden et al. | 164/97 |
| 2005/0011631 | A1* | 1/2005 | Hong | 164/498 |

FOREIGN PATENT DOCUMENTS

| | | |
|---|---|---|
| JP | H10-286663 | 10/1998 |
| JP | 2006-334665 | 12/2006 |

OTHER PUBLICATIONS

English Language Abstract for JP H10-286663 published Oct. 27, 1998.
English Language Abstract for CN 202239521 published May 30, 2012.
English Language Abstract for CN 101279362 published Oct. 8, 2008.

* cited by examiner

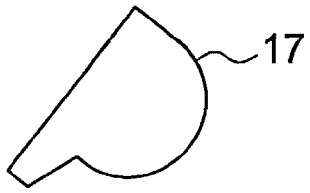
FIG. 7A
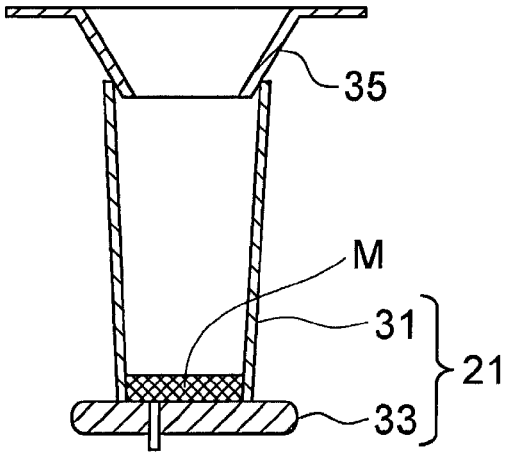
FIG. 7B
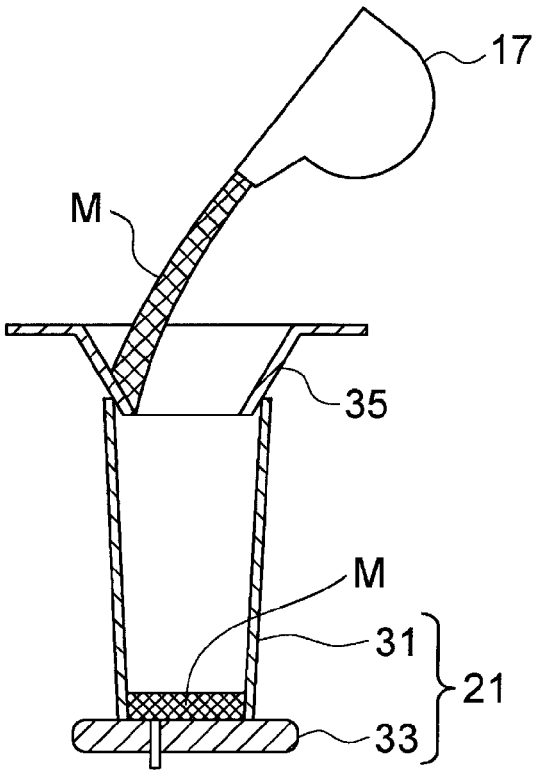

MOLDING APPARATUS, PRODUCTION APPARATUS OF SEMI-SOLIDIFIED METAL, PRODUCTION METHOD OF SEMI-SOLIDIFIED METAL, AND MOLDING METHOD

TECHNICAL FIELD

The present invention relates to a molding apparatus, a production apparatus of a semi-solidified metal, a production method of the semi-solidified metal, and molding method. The molding method is for example the semi-solid die casting method.

BACKGROUND ART

A semi-solidified metal is formed by a liquid-state metal material being cooled in a vessel. The metal material coheres an inner surface of the vessel in a process of forming a semi-solidified state, therefore after the metal material becomes a semi-solidified state, the semi-solidified metal sometimes cannot be smoothly taken out of the vessel even if the vessel is turned upside down.

Therefore, Patent Literature 1 discloses the following method as the method of taking out a semi-solidified metal from a vessel. First, the vessel is configured by a hollow member which is opened at its upper and lower ends and by a bottom member which closes the lower opening of the hollow member. Liquid-state metal material is poured into the vessel to form the semi-solidified metal. When the semi-solidified metal is formed, the bottom member is detached from the vessel. Then, a long-length pushing member is inserted from one opening of the hollow member, and the pushing member is used to push the semi-solidified metal toward the other opening of the hollow member.

CITATIONS LIST

Patent Literature

Patent Literature 1: Japanese Patent Publication No. 2006-334665A

SUMMARY OF INVENTION

Technical Problem

In the technique of Patent Literature 1, the pushing member is liable to push into the semi-solidified metal if the front end surface of the pushing member is narrow, therefore it cannot push out the semi-solidified metal. That is, the front end surface of the pushing member must be given a diameter equal to that of the hollow member, therefore the degree of freedom of design is low.

Accordingly, desirably there are provided a molding apparatus, a production apparatus of a semi-solidified metal, a production method of the semi-solidified metal, and molding method capable of suitably taking out the semi-solidified metal from a vessel and capable of improving the quality of the molded article.

Solution to Problem

A molding apparatus of the present invention has a sleeve which is communicated with a die, a production apparatus of a semi-solidified metal for feeding the semi-solidified metal into the sleeve, and a plunger for pushing the semi-solidified metal which is fed into the sleeve into the die. The production apparatus of the semi-solidified metal has a vessel which has a hollow member opened in up and down directions and a bottom member capable of closing the lower opening of the hollow member and capable of being separated from the hollow member and into which the liquid-state metal material is poured, and a cooling device which is capable of cooling the bottom member more than the hollow member.

A production apparatus of a semi-solidified metal of the present invention has a vessel which has a hollow member opened in up and down directions and a bottom member capable of closing the lower opening of the hollow member and capable of being separated from the hollow member and into which the liquid-state metal material is poured, and a cooling device capable of cooling the bottom member more than the hollow member.

A production method of a semi-solidified metal of the present invention has an arrangement step of arranging a hollow member opened in up and down directions above a bottom member and configuring a vessel, a pouring step of pouring a liquid-state metal material into the vessel, and a cooling step of cooling the bottom member more than the hollow member in the vessel into which the liquid-state metal material is poured.

A molding method of the present invention has the production method of the semi-solidified metal described above, a feeding step of feeding the semi-solidified metal which is produced by cooling of the liquid-state metal material in the vessel into a sleeve which is communicated with a die, and an injection step of pushing out the semi-solidified metal in the sleeve into the die by a plunger.

Advantageous Effects of Invention

According to the present invention, the semi-solidified metal can be suitably taken out of the vessel. Further, the quality of the molded article (product) can be improved.

BRIEF DESCRIPTION OF DRAWINGS

FIG. 7A and FIG. 7B are diagrams for explaining a modification of a pouring operation.

DESCRIPTION OF EMBODIMENTS

Figure 1:
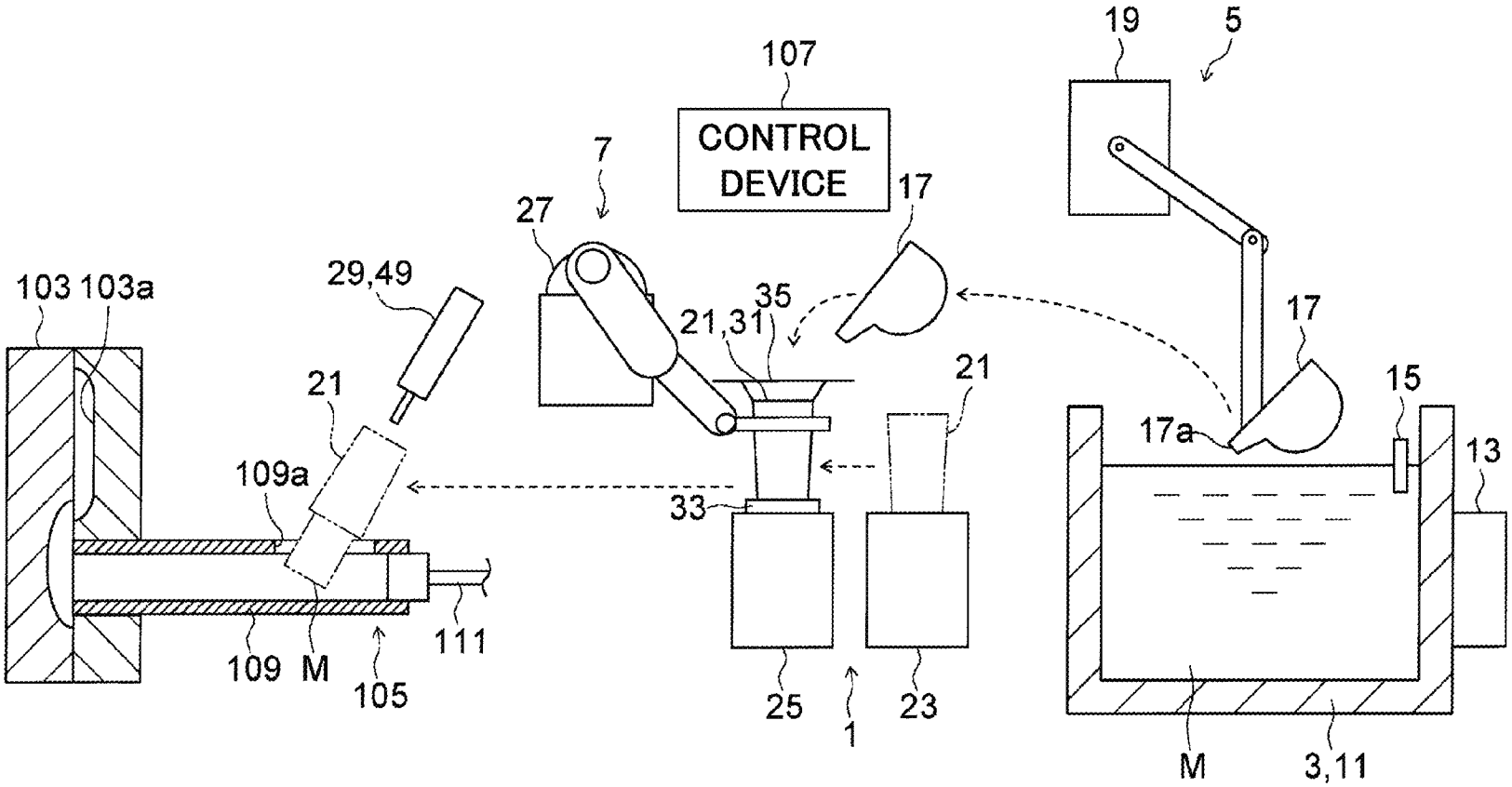
FIG. 1 is a schematic view which shows the configuration of principal parts of a molding machine including an apparatus for producing a semi-solidified metal according to an embodiment of the present invention.

FIG. 1 is a schematic view which shows the configuration of principal parts of a molding machine (molding apparatus) 101 including a production apparatus 1 of semi-solidified metal according to an embodiment of the present invention.

The molding machine 101 is for producing a molded article by solidifying a metal material M in a cavity 103*a* of a die 103. The molding machine 101 is for example a die-cast machine. In this case, the metal material M is for example an aluminum alloy.

The molding machine 101 has a production apparatus 1 for producing a semi-solidified state metal material M from a liquid-state metal material M, an injection device 105 for injecting that semi-solidified state metal material M into the cavity 103*a* in the die 103, and a control device 107 for controlling the production apparatus 1 and injection device 105 etc. Note that, although not particularly shown, other than them, the molding machine 101 has a clamping device for clamping the die 103, an extrusion device for pushing out the molded article formed in the die 103, and so on, and the control device 107 controls the clamping device, extrusion device, and so on as well.

The injection device 105 has a sleeve 109 communicated with the cavity 103*a* in the die 103, a plunger 111 which slides in the sleeve 109 to push out the metal material M, and a not shown drive device for driving the plunger 111. At the upper surface of the sleeve 109, a supply port 109*a* is formed. The semi-solidified state metal material M is dropped into the sleeve 109 through the supply port 109*a*.

The control device 107 is configured by for example a computer which includes a CPU, ROM, RAM, and external memory device. Note that, the control device 107 may be configured by control devices each of which is provided for each of various types of devices included in the molding machine 101, may be configured by one control device for controlling all devices included in the molding machine 101, or may be configured by a control device for controlling a plurality of devices included in the molding machine 101 and a control device for controlling the others.

The production apparatus 1 has for example a holding furnace 3 for holding the liquid-state metal material M, a pouring device 5 for scooping out the liquid-state metal material from the holding furnace 3, and a semi-solidification device 7 into which the liquid-state metal material is poured by the pouring device 5 and which renders the poured liquid-state metal material a semi-solidified state.

The holding furnace 3 may be given a known configuration. Further, the holding furnace 3 may act also as a melting furnace. For example, the holding furnace 3 has a furnace body 11 which holds the metal material M, a heating device 13 which heats the metal material M being held in the furnace body 11, and a first temperature sensor 15 which detects the temperature of the metal material M which is held in the furnace body 11.

The furnace body 11 is, for example, although not particularly shown, configured by a vessel which is made of a ceramic or another material excellent in thermal insulation in which a vessel which is made of a metal which has a higher solidus temperature or melting point than the liquidus temperature of the metal material M is arranged. The heating device 13 is configured by including for example a coil which heats the metal material M by electromagnetic induction or a combustion device which burns gas to heat the metal material M. The first temperature sensor 15 is configured by for example a thermocouple type temperature sensor or radiant thermometer.

The pouring device 5 may be given a known configuration. For example, the pouring device 5 has a ladle 17 and a ladle-conveying device 19 which is capable of driving the ladle 17.

The ladle 17 is a vessel which is made of a material which has a higher solidus temperature or melting point than the liquidus temperature of the metal material M and which has a pouring port 17*a*. It can hold one shot's worth of the metal material M. The ladle-conveying device 19 is configured by for example an articulated robot, can move the ladle 17 in an up/down direction and horizontal direction, and can incline the ladle 17 so as to move the pouring port 17*a* up and down.

The semi-solidification device 7 has for example a vessel 21 into which the liquid-state metal material M is poured by the pouring device 5, a pre-cooling device 23 which cools the vessel 21 before pouring the liquid-state metal material into the vessel 21, a setting device 25 on which the vessel 21 is set when the liquid-state metal material M is poured into the vessel 21, a vessel-conveying device 27 for conveying the vessel 21, and a pushing device 29 for taking out the semi-solidified state metal material M from the vessel 21.

The vessel 21 is comprised by a material (preferably a metal) which has a higher solidus temperature or melting point than the liquidus temperature of the metal material M and preferably has a relatively high thermal conductivity. The vessel 21 can hold one shot's worth of the metal material M.

The pre-cooling device 23 cools the vessel 21 by for example immersing the vessel 21 in a coolant. The coolant may be a gas or may be a liquid. As will be explained later, the setting device 25 has a cooling function of the vessel 21 as well. By providing the pre-cooling device 23 in addition to the setting device 25, for example, the vessel 21 into which the metal material is to be poured is cooled by the pre-cooling device 23 while pouring the metal material M into the vessel 21 set on the setting device 25 and thus a cycle time can be shortened.

The vessel-conveying device 27 is configured by for example an articulated robot, can move the vessel 21 in an up/down direction and horizontal direction, and can change the orientation of the up/down direction of the vessel 21 (turn the vessel 21 upside down). The vessel-conveying device 27 transports the vessel 21 from the pre-cooling device 23 to the setting device 25, transports the vessel 21 from the setting device 25 to the top of the sleeve 109, and so on.

Figure 2:
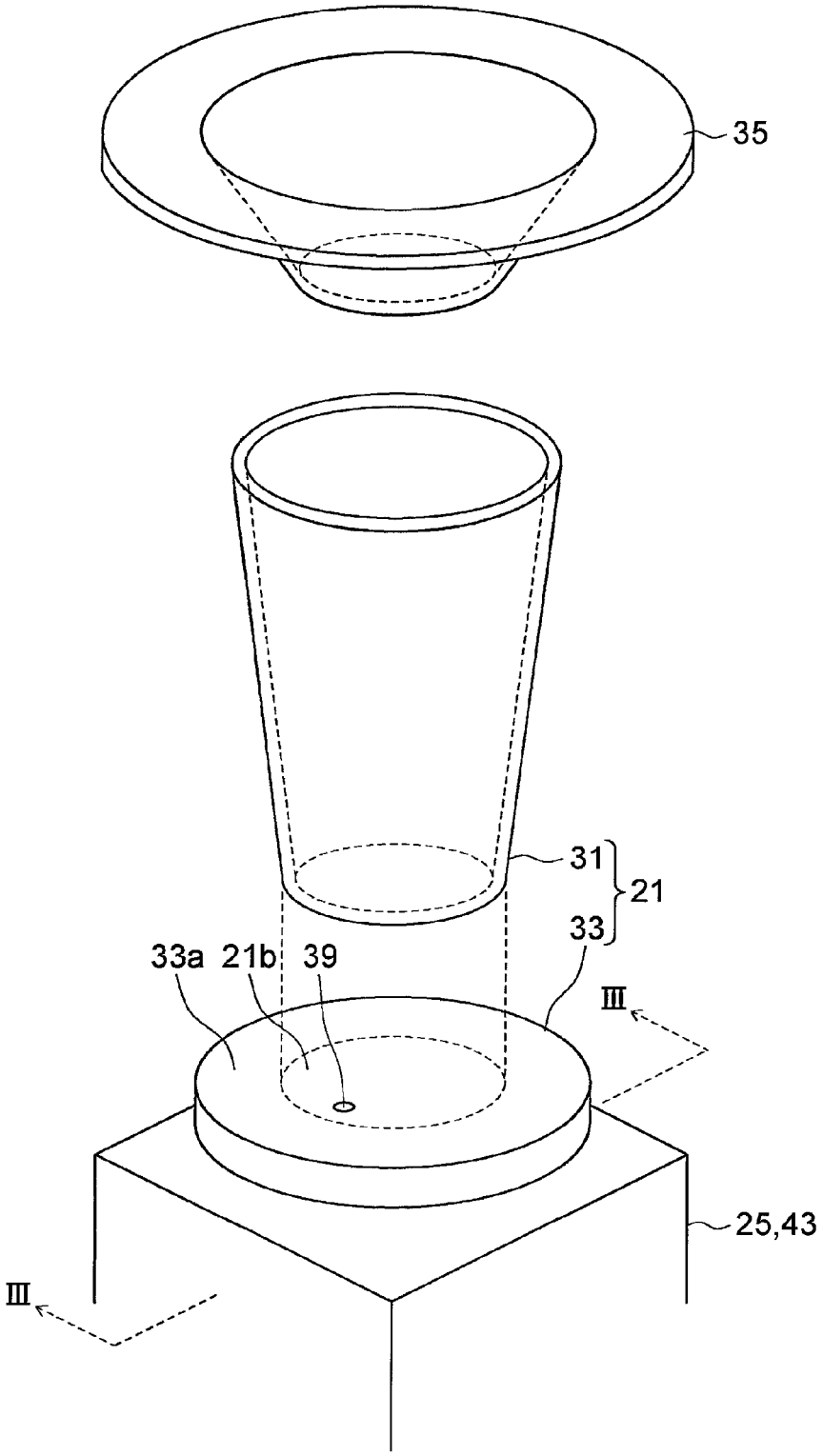
FIG. 2 is a perspective view which shows a portion around a vessel of the production apparatus of the semi-solidified metal in FIG. 1.
Figure 3:
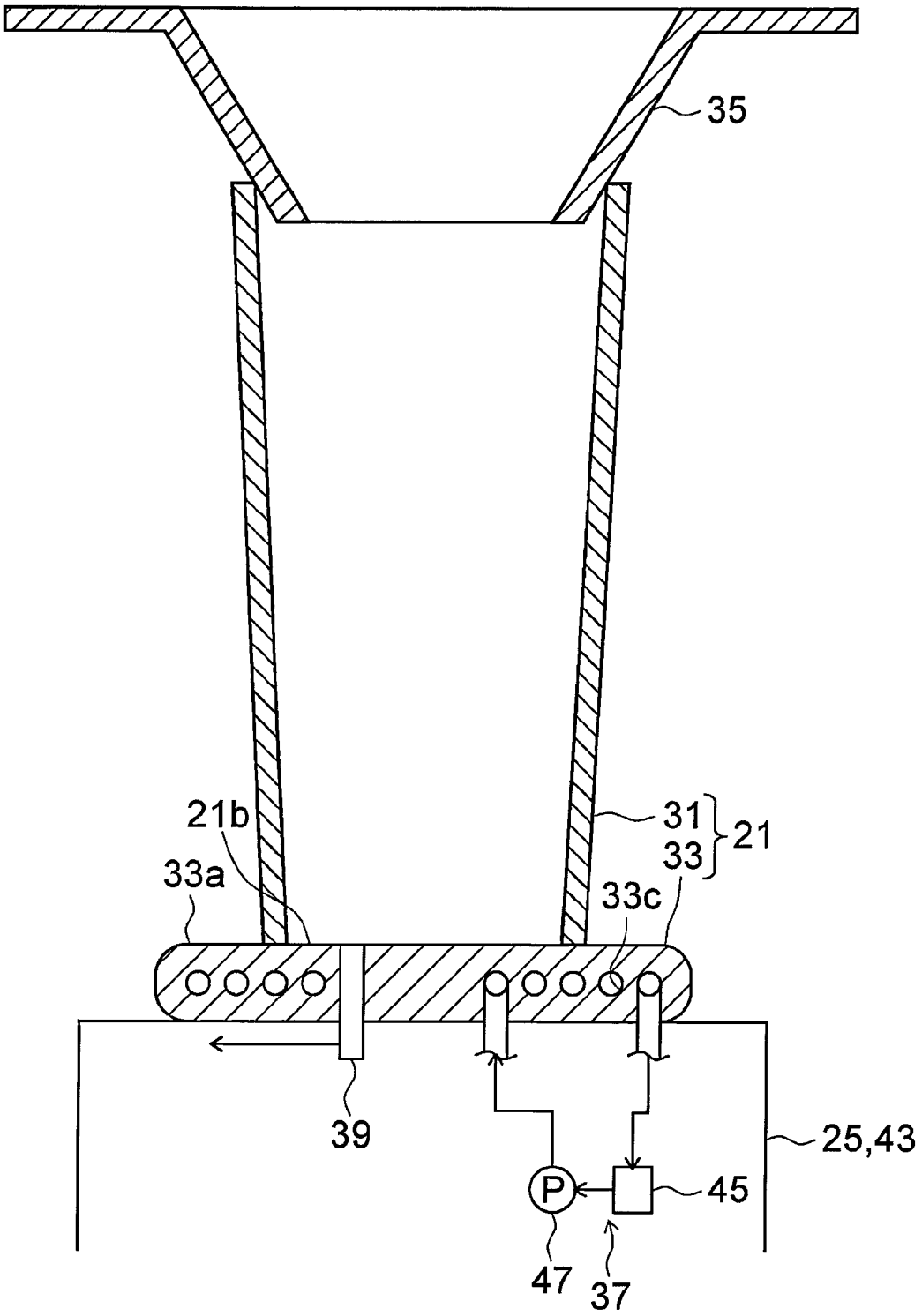
FIG. 3 is a cross-sectional view taken along a line in FIG. 2.

FIG. 2 is a perspective view which shows a peripheral portion of the vessel 21 in the production apparatus 1 of the semi-solidified metal. FIG. 3 is a cross-sectional view taken along a line in FIG. 2.

The vessel 21 has a hollow member 31 which configures a wall section of the vessel 21 and a bottom member 33 which configures the bottom of the vessel 21. They can be separated. Above the vessel 21, a funnel 35 for assisting pouring of the liquid-state metal material M into the vessel 21 is arranged.

Further, the setting device 25 has an auxiliary cooling device 37 (FIG. 3) for cooling the vessel 21 and a second temperature sensor 39 which detects the temperature of the metal material M in the vessel 21.

Note that, the hollow member 31 is sometimes turned upside down by conveyance. However, "upper", "lower", and other terms will be used for the hollow member 31 with reference to the top and bottom when the liquid-state metal material M is poured as shown in FIG. 2 and FIG. 3. Further, the same is true also for the semi-solidified state metal material M which is held in the hollow member 31.

The hollow member 31 is formed in a hollow shape which has openings at both of the upper and lower ends. The shape of the hollow member 31 seen in the opening direction may be suitably set. However, from the viewpoint of equally cooling the metal material M, it is preferably a circle (the hollow member 31 is preferably cylindrical). The thickness of the hollow member 31 is for example constant.

Note that, FIG. 3 exemplifies a case where the inside diameter of the hollow member 31 is made larger toward the upper part. Note, the inside diameter of the hollow member 31 may be constant from the upper end to the lower end as well. Further, on the outer peripheral surface of the hollow member 31, a part which has a suitable shape may be formed so that the operation of holding (for example gripping) the hollow member 31 by the vessel-conveying device 27 is easily or reliably carried out.

The bottom member 33 is for example a roughly plate-shaped member. The planar shape of the bottom member 33 may be suitably set. A circle is exemplified in the present embodiment. The outer shape of the bottom member 33 when seen by a plan view is set broader than the opening of the hollow member 31. The thickness of the bottom member 33 is for example made constant. Note, the thickness may differ between the center side and the outer periphery side. Further, an upper surface 33*a* of the bottom member 33 may be provided with an inclination. For example the height may differ between the center side and the outer periphery side.

The vessel 21 is configured with the hollow member 31 placed on the upper surface 33*a* of the bottom member 33 and with the lower opening of the hollow member 31 closed by the bottom member 33. In FIG. 2, a region in the upper surface 33*a*, which is surrounded by a dotted line, configures the bottom surface 21*b* of the vessel 21.

Note that, between the hollow member 31 and the bottom member 33, a relatively very small clearance through which the metal material M cannot flow out and air (gas) can flow out may be formed as well. Such a clearance is useful for letting air escape when pouring the metal material M into the vessel 21 and suppressing entrainment of air in the metal material M.

The hollow member 31 and the bottom member 33 are fixed to each other. For example, the bottom member 33 is supported upon a base 43 of the setting device 25, and the hollow member 31 is pressed from the top by the funnel 35, therefore the members are fixed. The funnel 35 is held in position by for example the vessel-conveying device 27 or another robot and is given force for pressing against the hollow member 31.

Note that, the hollow member 31 and the bottom member 33 may be fixed to each other by a suitable clamping means. The clamping means or another means for fixing the hollow member 31 and the bottom member 33 to each other may not be provided, and the hollow member 31 may be only placed on the bottom member 33. Further, preferably the bottom member 33 is fixed on the base 43. For example, the bottom member 33 is fixed on the base 43 by not shown screws. The hollow member 31 and bottom member 33 may have positioning portions for positioning them relative to each other in the horizontal direction as well. For example, a groove section for accommodating the lower edge part of the hollow member 31 may be formed in the bottom member 33 as well.

The materials of the hollow member 31 and the bottom member 33 may be the same as each other or may be different from each other. When they are different from each other, the material of the bottom member 33 preferably has a higher thermal conductivity than the material configuring the hollow member 31. For example, in contrast to the hollow member 31 being configured by stainless steel, the bottom member 33 is configured by copper (pure copper).

Further, the thicknesses of the hollow member 31 and the bottom member 33 may be the same as each other or may differ from each other. When they differ from each other, the thickness of the bottom member 33 is preferably thicker than the thickness of the hollow member 31.

The funnel 35 is comprised of a material (preferably a metal) which has a higher solidus temperature or melting point than the liquidus temperature of the metal material M, preferably a relatively high thermal conductivity. The funnel 35 is a hollow-shaped member which has a diameter which becomes larger toward the upper side, and the lower end is inserted into the upper opening of the vessel 21. Note that, preferably the inclination of the inner wall of the funnel 35 is larger than the inclination of the inner wall of the vessel 21.

The auxiliary cooling device 37 (FIG. 3) for example cools the bottom member 33 in the vessel 21. The auxiliary cooling device 37 is configured by including for example channels 33*c* formed in the bottom member 33, a heat exchanger 45 for cooling the coolant flowing in the channel 33*c*, and a pump 47 for causing flow of the coolant.

The coolant is for example water. The shape of the channel 33*c* may be suitably set. In FIG. 3, channels 33*c* in a shape surrounding the center of the bottom member 33 may be exemplified. The heat exchanger 45 and pump 47 may be given known configurations.

The second temperature sensor 39 is for example a contact type temperature sensor. More specifically, it is for example a thermocouple type temperature sensor. The second temperature sensor 39 is arranged in the bottom member 33. More specifically, for example, the second temperature sensor 39 is fitted in a hole section passing through the bottom member 33 in the up/down direction and is exposed in the vessel 21 at the bottom surface 21*b*. Accordingly, the second temperature sensor 39 abuts against the metal material M poured in the vessel 21 and can directly detect the temperature of the metal material M.

Note that, the top face of the second temperature sensor 39 preferably continues to the top surface 33*a* of the bottom member 33 so as not to cause a difference in level at the bottom surface 21*b* of the vessel 21. The second temperature sensor 39 may be arranged at a suitable position in the bottom surface 21*b*. In the present embodiment, the case where it is arranged at a position which shifts a little from the center of the bottom surface 21*b* is exemplified.

Figure 4:
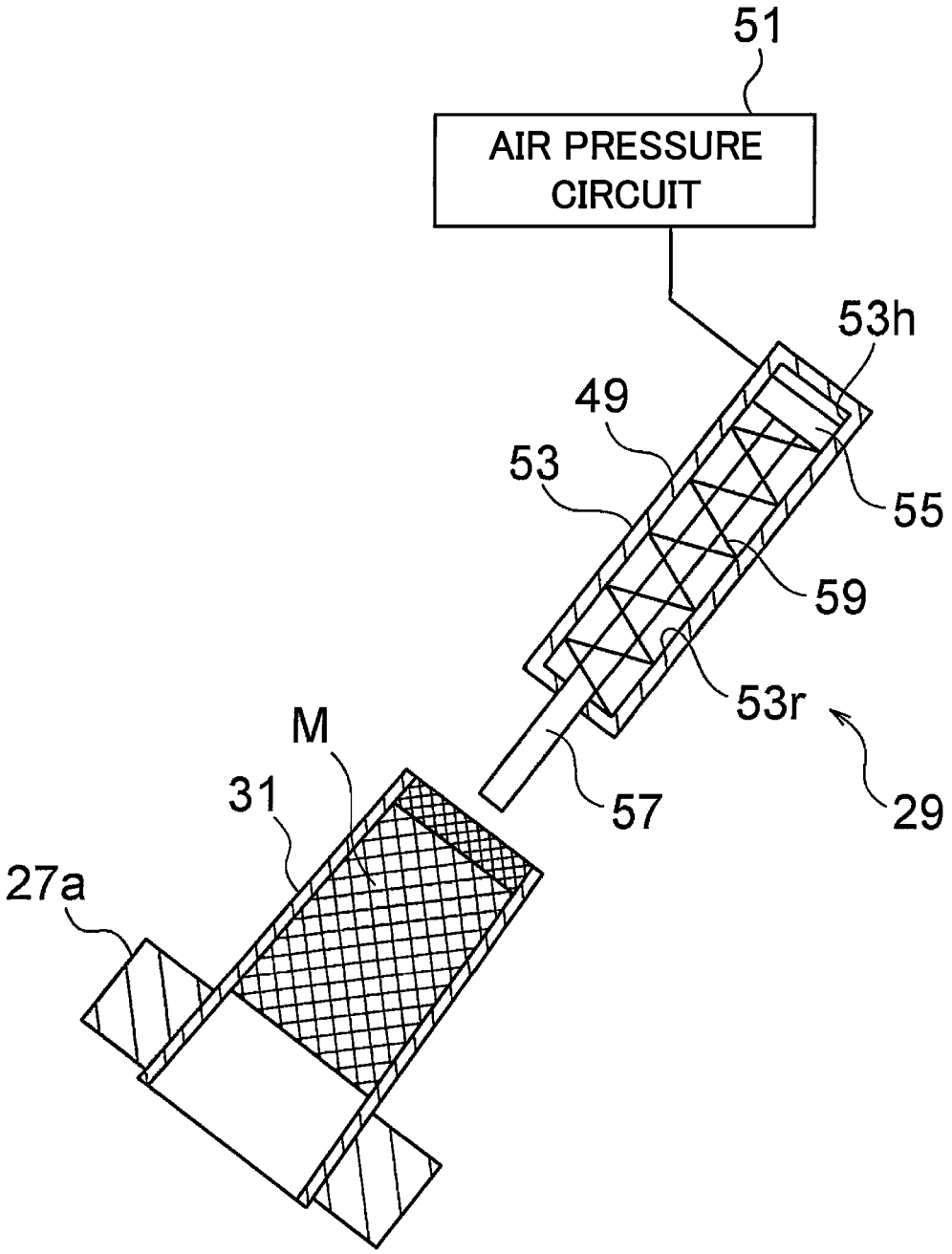
FIG. 4 is a schematic view which shows the configuration of a pushing device of the production apparatus of the semi-solidified metal in FIG. 1.

FIG. 4 is a schematic view which shows the configuration of the pushing device 29.

The pushing device 29 for example has an air cylinder 49 and an air pressure circuit 51 for supplying air to the air cylinder 49.

The air cylinder 49 is configured by for example a single acting type cylinder with a spring and has a cylinder section 53, a piston 55 which can slide in the cylinder section 53, a piston rod 57 which is fixed to the piston 55 and extends outward from the cylinder section 53, and a spring 59 for biasing the piston 55.

The piston 55 divides the inside of the cylinder section 53 into a rod side chamber 53*r* at the front side (piston rod 57 side) and a head side chamber 53*h* at the rear side (opposite side to the piston rod 57). Then, by supply of air into the head side chamber 53*h*, the piston 55 and piston rod 57 advance. Note that, the rod side chamber 53*r* is for example exposed to the atmosphere.

The spring 59 is for example accommodated in the rod side chamber 53*r* and biases the piston 55 backward relative to the cylinder section 53. Accordingly, when the head side chamber 53*h* is depressurized, the piston 55 and piston rod 57 move back.

The air cylinder 49 is for example provided in a fixed manner relative to the sleeve 109, which is above than the supply port 109*a* of the sleeve 109 and at the back of the supply port 109*a* as shown in FIG. 1. Further, the air cylinder 49 is arranged so as to be inclined in a front-back direction relative to the vertical direction and so that the direction of outward extension of the piston rod 57 is directed to the supply port 109*a*. Note that, the air cylinder 49 needs not be positioned at the back of the entire supply port 109*a* as a whole.

On the other hand, as shown in FIG. 1 and FIG. 4, between the supply port 109*a* and the air cylinder 49, the hollow member 31 holding the metal material M which is rendered the semi-solidified state is conveyed. The hollow member 31 is inclined in roughly the same direction as the air cylinder 49 relative to the vertical direction, so that the upper side is directed toward the supply port 109*a* and the bottom side is directed toward the air cylinder 49.

Accordingly, by moving the holding section 27*a* of the vessel-conveying device 27 holding the hollow member 31 to the air cylinder 49 side and/or making the piston rod 57 stick out from the cylinder section 53, the piston rod 57 can abut against the bottom portion of the semi-solidified state metal material M.

The air pressure circuit 51 is, although particularly not shown, configured by including a pump, accumulator, valve, etc. and operates based on control signals from the control device 107. The air pressure circuit 51 is connected to the head side chamber 53*h* and can control the pressure in the head side chamber 53*h*.

For example, by opening/closing the valve between the accumulator and the head side chamber 53*h*, the air pressure circuit 51 can supply air which is accumulated in the accumulator and has a predetermined pressure to the head side chamber 53*h* at a suitable timing and with a suitable time length. Further, by opening/closing the valve between the outside of the air pressure circuit 51 (atmosphere) and the head side chamber 53*h*, the air pressure circuit 51 can depressurize the head side chamber 53*h* at a suitable timing and with a suitable time length.

Further, the air pressure circuit 51 can repeatedly supply air into the head side chamber 53*h* and depressurize the head side chamber 53*h* as explained above in a suitable cycle. In this case, the piston rod 57 repeats the advance by pressure of the head side chamber 53*h* and backward movement by the spring 59. That is, the pushing device 29 can make the piston rod 57 move back and forth (vibrate) in a direction approaching/separating from the semi-solidified state metal material M.

(Operation of Production Apparatus)

Next, the operation of the molding machine 101 will be explained focusing on the operation of the production apparatus 1.

The control device 107 controls the heating device 13 based on the detection value of the first temperature sensor 15 and maintains the temperature of the metal material M held in the furnace body 11 at a predetermined first temperature $T_1$. The first temperature $T_1$ is a temperature higher than the liquidus temperature of the metal material M, so the metal material M is fully rendered the liquid state.

The bottom member 33 in the vessel 21 is placed on the base 43 of the setting device 25 as it is throughout all processes of the molding machine 101. The control device 107 controls the auxiliary cooling device 37 based on the detection value of the not shown temperature sensor or second temperature sensor 39 and renders the temperature of the bottom member 33 before the metal material M is poured into the vessel 21 a predetermined second temperature $T_2$. The second temperature $T_2$ is a temperature lower than the liquidus temperature of the metal material M.

The hollow member 31 in the vessel 21 can move over the pre-cooling device 23, setting device 25, and sleeve 109 by conveyance to the vessel-conveying device 27. The control device 107 controls the vessel-conveying device 27 so as to convey the hollow member 31 to the pre-cooling device 23 and controls the pre-cooling device 23 so as to render the temperature of the hollow member 31 a predetermined third temperature $T_3$. The third temperature $T_3$ is a temperature lower than the liquidus temperature of the metal material M.

Note that, $T_2$ and $T_3$ may be the same as each other or may differ from each other. When they differ from each other, preferably $T_2<T_3$ stands. In the case of $T_2<T_3$, compared with $T_2=T_3$, the metal material M becomes easier to solidify on the bottom side of the vessel 21.

FIG. 5A to FIG. 5D and FIG. 6A to FIG. 6D are schematic views for explaining processes after the bottom member 33 and hollow member 31 into which the metal material M has not yet been poured are cooled to the second temperature $T_2$ and third temperature $T_3$.

Figure 5A:
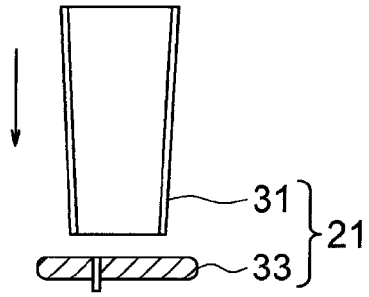
FIG. 5A to FIG. 5D are schematic views for explaining the operation of a molding machine focusing on the operation of the production apparatus of the semi-solidified metal.

As shown in FIG. 5A, the control device 107 controls the vessel-conveying device 27 so as to convey the hollow member 31 onto the bottom member 33. Due to this, the vessel 21 comprising the hollow member 31 and bottom member 33 is configured.

Figure 5B:
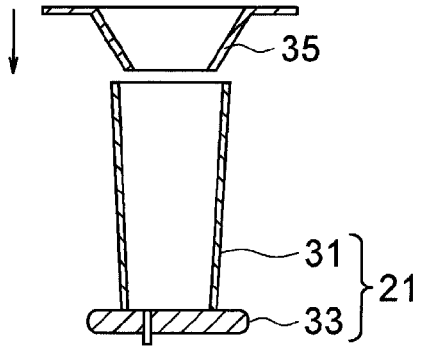

Next, as shown in FIG. 5B, the control device 107 controls the vessel-conveying device 27 or another not shown robot so as to convey the funnel 35 to the top of the hollow member 31. Due to this, as already explained, the hollow member 31 is pressed by the funnel 35 and is held in position.

Figure 5C:
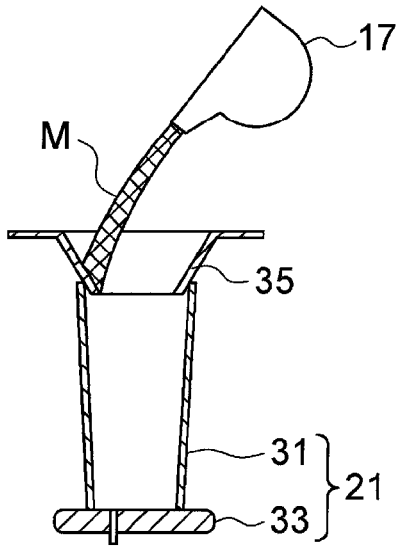

Next, as shown in FIG. 5C, the control device 107 controls the ladle-conveying device 19 so that the ladle 17 pours the liquid-state metal material M through the funnel 35 into the vessel 21.

At this time, the position etc. of the ladle 17 are preferably controlled so that the metal material M contacts (strikes) the inner surface of the funnel 35. In this case, the heat of the metal material M is transferred to the funnel 35, and convection occurs in the metal material M. As a result, smooth cooling of the metal material M is expected.

Figure 5D:
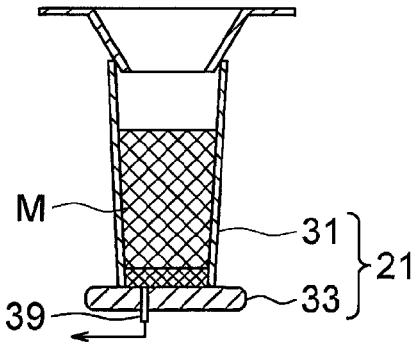

As shown in FIG. 5D, when the metal material M is poured into the vessel 21, the heat of the metal material M is transferred to the vessel 21 so the metal material M is cooled. Further, by the metal material M being poured into the vessel 21 from a certain extent of height, a flow is caused and the material is agitated. As a result, the metal material M is rendered the semi-solidified state.

At this time, the cooling at the bottom of the vessel 21 is carried out prior to the cooling at the middle and upper parts of the vessel 21. That is, the cooling speed at the bottom of the metal material M is faster than the cooling speed at the middle and upper parts of the metal material M. From another viewpoint, in the metal material M, a temperature gradient arises whereby the temperature at the bottom becomes low compared with the temperatures at the middle and upper parts.

Such cooling is realized by for example at least one of the configurations or operations which will be listed below. The thickness of the bottom member 33 is thicker than the thickness of the hollow member 31. The thermal conductivity of the bottom member 33 is higher than the thermal conductivity of the hollow member 31. $T_2<T_3$ stands. Even after pouring, the cooling of the bottom member 33 by the auxiliary cooling device 37 continues.

Further, by such cooling, as will be explained later, in the semi-solidified state metal material M which is formed in the vessel 21, a bottom portion which has a higher solid phase rate than the other portions is formed.

Note that, by performing experiments and simulation etc., as will be explained later, the thickness of the bottom member 33, quantity of cooling of the bottom member 33 by the auxiliary cooling device 37, and so on are designed or set so that the amount of the bottom portion in the semi-solidified state metal material M formed becomes for example not more than a half of the amount of the biscuit (casting plan part).

As shown by hatching of the metal material M which is made different between the bottom portion and the middle and upper parts, the cooling speed of the metal material M in the bottom portion is faster than the cooling speed at the middle and upper parts of the metal material M, therefore the solid phase rate of the bottom portion of the metal material M becomes higher compared with the solid phase rates of the middle and upper parts of the metal material M.

Further, in the metal material M, the cooling speed at the bottom portion is faster than the cooling speeds at the middle and upper parts, therefore agitation at the bottom portion is liable to become insufficient compared with the agitation at the middle and upper parts. Then, in the bottom portion, the cooling speed is fast and agitation is insufficient, therefore the crystal becomes dendritic and fine. On the other hand, at the middle and upper parts, the cooling speed is slow and agitation is sufficient, therefore the crystal grows round (granularly).

In the process of cooling of the metal material M, the control device 107 monitors the temperature detected by the second temperature sensor 39. The detection temperature of the second temperature sensor 39 suddenly rises due to the liquid-state metal material M being poured into the vessel 21 and the metal material M abuts against the second temperature sensor 39. After that, by the heat of the metal material M being robbed by the vessel 21, the temperature falls. The control device 107 judges whether this falling temperature reaches the predetermined target temperature $T_t$.

There is correlation between the temperature detected by the second temperature sensor 39 and the solid phase rate of the semi-solidified metal. Then, the target temperature $T_t$ is set to a temperature corresponding to the desired solid phase rate based on experiments etc. using the production apparatus 1.

Note that, in the present embodiment, as explained above, it is intended that the bottom portion of the metal material M become a high solid phase rate. Further, the second temperature sensor 39 is influenced by the auxiliary cooling device 37. Therefore, according to some configurations of the production apparatus 1, the detection temperature of the second temperature sensor 39 sometimes becomes lower than the temperature of the bottom portion of the metal material M. Accordingly, the target temperature $T_t$ need not to be higher than the solidus temperature of the metal material M.

Further, the vessel 21 is sufficiently cooled in advance and/or cooling by the auxiliary cooling device 37 is continued even after pouring of the metal material M so that the vessel 21 and the metal material M do not reach thermal equilibrium before the detection temperature of the second temperature sensor 39 reaches the target temperature $T_t$.

When the temperature detected by the second temperature sensor 39 reaches the target temperature $T_t$, the control device 107 suspends cooling of the metal material M and starts processing for taking out the metal material M from the vessel 21.

Figure 6A:
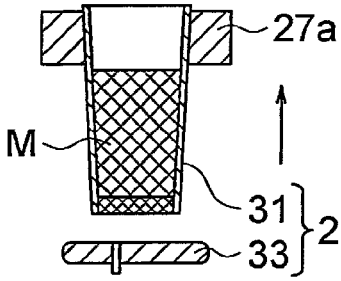
FIG. 6A to FIG. 6D are schematic views for explaining the continuation of FIG. 5D.

Specifically, first, the vessel-conveying device 27 or another not shown robot is controlled so as to detach the funnel 35. Further, as shown in FIG. 6A, the vessel-conveying device 27 is controlled so as to lift the hollow member 31. The semi-solidified state metal material M is held in the hollow member 31, so it is separated from the bottom member 33 together with the hollow member 31.

Figure 6B:
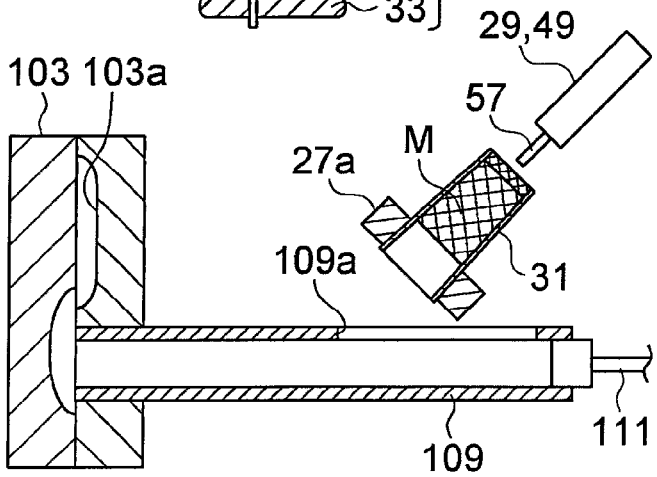

Next, as shown in FIG. 6B, the control device 107 controls the vessel-conveying device 27 so as to convey the hollow member 31 holding the metal material M between the supply port 109*a* of the sleeve 109 and the air cylinder 49. The hollow member 31 is arranged inclined relative to the vertical direction and so that its bottom side is directed to the air cylinder 49 and its upper part side is directed to the supply port 109*a*.

At this point of time, the bottom surface of the metal material M has not abutted against the tip of the piston rod 57. For example, the bottom surface of the metal material M is positioned outside the stroke of the piston rod 57 (its tip), or is located at a position which is inside the stroke of the piston rod 57, but is separated from the piston rod 57 located at the retraction limit by a predetermined distance.

Figure 6C:
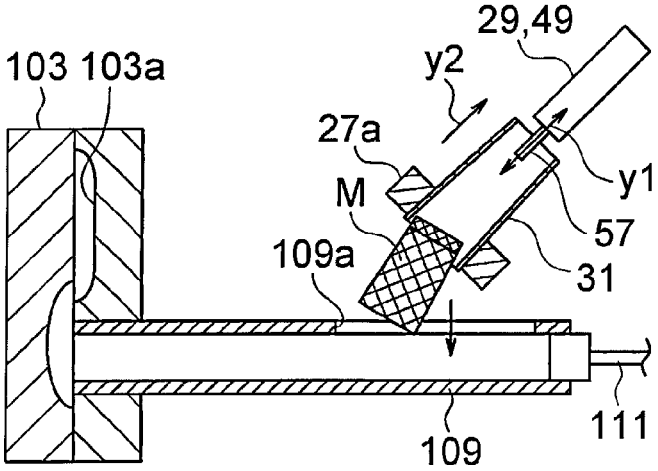

Next, as shown in FIG. 6C, the control device 107 controls the air pressure circuit 51 so as to make the piston rod 57 move back and forth (see an arrow y1) and controls the vessel-conveying device 27 so as to make the hollow member 31 approach the air cylinder 49. Note that, the speed of making the hollow member 31 approach the air cylinder 49 is slower than the speed of retraction of the piston rod 57. Further, either movement of the hollow member 31 or vibration of the piston rod 57 may be started previously or may be started simultaneously.

As a result of the operation as described above, the piston rod 57 repeatedly strikes the bottom surface of the semi-solidified state metal material M. Due to the strikes, the metal material M is peeled off from the inner surface of the hollow member 31 and falls from the hollow member 31.

Note that, the stroke of the air cylinder 49, operation of the air cylinder 49, operation of the vessel-conveying device 27, and so on may be set so that the metal material M falls to the outside of the hollow member 31 by only gravity after the metal material M is displaced relative to the hollow member 31 to a certain extent from the initial position or may be set so that the piston rod 57 abuts against the metal material M until roughly the entire metal material M is positioned outside of the hollow member 31.

The metal material M which falls from the hollow member 31 is held in the sleeve 109 through the supply port 109*a*. The hollow member 31 is turned upside down with inclination so as to be inclined relative to the vertical direction to direct the upper opening toward the front of the sleeve 109 from its rear. Therefore, in the sleeve 109, the metal material M directs the upper portion toward the die 103 (cavity 103*a*) side and directs the bottom portion toward the plunger 111 side.

Figure 6D:
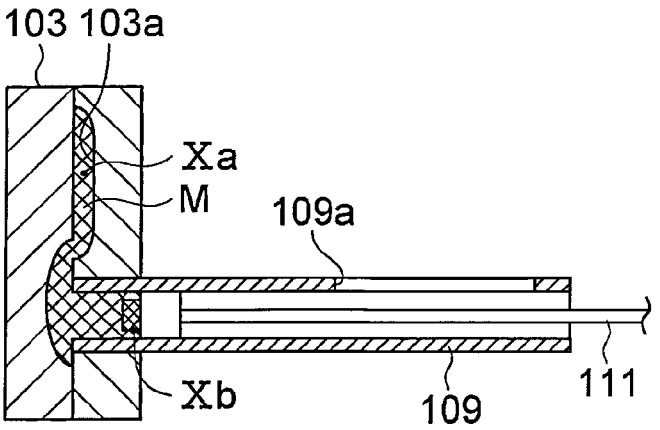

After that, as shown in FIG. 6D, when the plunger 111 advances in the sleeve 109, the metal material M is injected into the cavity 103*a* in the die 103. Then, by the metal material M being cooled in the cavity 103*a* (in the die 103) and solidified, a molded article is formed.

At this time, in the metal material M, the bottom portion which has a high solid phase rate is contained in the biscuit. The size of the biscuit is for example 15 mm to 30 mm in the movement direction of the plunger 111. The bottom portion which has a high solid phase rate has for example an amount not more than half of the former.

As described above, in the present embodiment, the production apparatus 1 of semi-solidified metal has the vessel 21 and auxiliary cooling device 37. The vessel 21 into which the liquid-state metal material M is poured has the hollow member 31 which is opened in the up/down direction and the bottom member 33 which can close the lower opening of the hollow member 31 and can be separated from the hollow member 31. The auxiliary cooling device 37 directly cools only the bottom member 33 in the vessel 21. In other words, the auxiliary cooling device 37 can cool the bottom member 33 more than the hollow member 31.

Accordingly, the bottom portion of the semi-solidified metal which is exposed from the hollow member 31 by separating the bottom member 33 from the hollow member 31 becomes high in solid phase rate. As a result, for example, this portion which has a high solid phase rate can be pushed. Consequently, the semi-solidified metal can be suitably taken out. For example, sinking of the piston rod 57 into the metal material M is suppressed. As a result, for example, the necessity of making the member pushing the metal material M large in the abutment area against the metal material M is reduced. That is, the degree of freedom of design becomes high. On the other hand, it is only a portion (bottom portion) that has a high solid phase rate, therefore the quality can be made high as a whole.

Further, in the present embodiment, the pushing device 29 repeatedly makes the piston rod 57 strike the bottom portion of one semi-solidified state metal material M.

Accordingly, impact peeling off the metal material M from the vessel 21 (hollow member 31) can be effectively imparted to the metal material M. From another viewpoint, compared with a case where the metal material M is pushed slowly by one stroke, the pushing device 29 (air cylinder 49) can be smaller in size. Reduction of the holding power of the holding section 27*a* can be expected also for the vessel-conveying device 27 which holds the vessel 21 when the metal material M is extruded.

Further, in the present embodiment, the production apparatus 1 has the vessel-conveying device 27 for conveying at least a portion of the vessel 21. The vessel 21 has the hollow member 31 which configures the wall section of the vessel and is opened at both of the upper and lower ends and the bottom member 33 which closes the lower opening of the hollow member 31 and configures the bottom of the vessel 21. The pushing device 29 makes the piston rod 57 move back and forth. The vessel-conveying device 27 separates the hollow member 31 which holds the semi-solidified metal from the bottom member 33 after the semi-solidified metal is formed in the vessel 21, then conveys the hollow member 31 so as to make the lower opening of the hollow member 31 approach the reciprocating piston rod 57.

Accordingly, the configuration for making the piston rod 57 repeatedly strike the bottom portion of the metal material M as described above can be made simpler and more effective as a whole. Specifically, first, by separation of the vessel 21, the bottom portion of the metal material M is conveniently exposed. Further, the vessel-conveying device 27 is used for both of the separation operation of the vessel 21 and the striking operation of the piston rod 57 with the metal material M. By this multi-use, for example, the stroke of the air cylinder 49 can be made smaller. From another viewpoint, movement of the air cylinder 49 (cylinder section 53) is unnecessary. Further, the metal material M is struck at a speed which is the sum of the movement speed of the hollow member 31 by the vessel-conveying device 27 and the movement speed of the piston rod 57, therefore the striking operation is effectively performed.

Further, in the present embodiment, the molding machine 101 has the production apparatus 1 of the semi-solidified metal exerting various effects as described above, the sleeve 109 communicated with the cavity 103*a* in the die 103, and the plunger 111 which extrudes the semi-solidified state metal material M which is fed into the sleeve 109 into the cavity 103*a* in the die 103. The production apparatus 1 feeds the metal material M into the sleeve 109 so as to direct the upper portion side of the semi-solidified state metal material M toward the die 103 (cavity 103*a*) side and direct the bottom portion side of the metal material M toward the plunger 111 side. Further, in the present embodiment, by utilizing results by experiments and simulation etc., the semi-solidified state metal material M is formed so that, in the semi-solidified state metal material M which is formed in the vessel 21, the thickness of the bottom portion, which is given a solid phase rate higher than those at the middle and upper portions, becomes a half of the thickness of the biscuit or less. Note that, the cross-sectional area parallel to the bottom surface of the vessel 21 and the cross-sectional area perpendicular to the injection direction of the sleeve 109 are close to each other.

Accordingly, in the semi-solidified state metal material M, the bottom portion in which the crystal has not grown granularly is positioned at the biscuit side, and the upper and middle portions in which the crystal has grown granularly are positioned on the product part side. More preferably, the bottom portion of the metal material M is contained in the biscuit. That is, in molding of the molded article, the bottom portion in the semi-solidified state metal material M in which the crystal did not grow granularly does not become a portion of the molded article (product). As a result, the quality of the product (molded article) can be improved while obtaining the preferred effect due to the solid phase rate of the bottom portion side being made high as described above.

Further, in the present embodiment, the method of producing the semi-solidified metal has an arrangement step (FIG. 5A) of arranging the hollow member 31 which is opened in the up/down direction on the bottom member 33 and configuring the vessel 21, the pouring step (FIG. 5C) of pouring the liquid-state metal material M into the vessel 21, and the cooling step (FIG. 5D) of cooling the bottom member 33 more than the hollow member 31 in the vessel 21 into which the liquid-state metal material M is poured. Accordingly, the same effects as those by the production apparatus 1 in the present embodiment explained above are exerted.

Further, in the present embodiment, the molding method has the steps of the production method described above, the feeding step (FIG. 6C) of feeding the semi-solidified metal into the sleeve 109 communicated with the cavity 103*a* in the die 103, and the injection step (FIG. 6D) of extruding the semi-solidified metal in the sleeve 109 into the cavity 103*a* in the die 103 by the plunger 111. The feeding step is for feeding the semi-solidified metal to the sleeve 109 so that the upper portion side of the semi-solidified metal is directed toward the die 103 (cavity 103*a*) side and the bottom portion side of the semi-solidified metal is directed toward the plunger 111 side. Accordingly, the same effects as those by the molding machine 101 in the present embodiment explained above are exerted.

(Modification of Pouring Operation)

FIG. 7A and FIG. 7B are diagrams for explaining a modification of the pouring operation of the liquid-state metal material M into the vessel 21.

In this modification, the structures of the molding machine 101 and the production apparatus 1 of semi-solidified metal are the same as those in the first embodiment. Further, operations other than the pouring operation of the liquid-state metal material M into the vessel 21 are the same as those in the first embodiment.

In the pouring operation of this modification, first, in the same way as the embodiment, the liquid-state metal material M is poured into the vessel 21 through the funnel 35 (see FIG. 5C). However, in contrast to the embodiment in which one shot's worth of the metal material M held by the ladle 17 was fully poured into the vessel 21 all at once, in this modification, as shown in FIG. 7A, pouring is once interrupted.

During this interruption of pouring, the metal material M which has been already poured into the vessel 21 is cooled since its heat is transferred to the vessel 21. On the other hand, the metal material M which remains in the ladle 17 is not cooled. That is, a temperature difference arises between the two. From another viewpoint, the solid phase rate rises in the already poured metal material M. Further, the amount of the metal material M which is poured into the vessel 21 before the pouring is once interrupted is determined by utilizing the results of experiments and simulation etc. to an amount such that the height in the vessel 21 of the metal material M which has been poured before pouring is once interrupted becomes the amount not more than the half of the thickness of the biscuit. Note that, the cross-sectional area parallel to the bottom surface of the vessel 21 and the cross-sectional area perpendicular to the injection direction of the sleeve 109 are close.

Next, as shown in FIG. 7B, pouring of the liquid-state metal material M into the vessel 21 is restarted. The poured metal material M is cooled together with the metal material M which already exists in the vessel 21 since its heat is transferred to the vessel 21. Further, in the vessel 21, agitation occurs due to pouring of the metal material M.

Accordingly, the metal material M which is poured into the vessel 21 is rendered into the semi-solidified state as a whole, while the previously poured metal material M mainly configures the bottom portion of the semi-solidified metal. Then, this bottom portion becomes a solid phase rate higher than those at the middle and upper portions since it was cooled previously. As a result, various effects the same as those by the above embodiment are obtained.

In this way, the method of performing cooling of the metal material M at the bottom prior to the cooling of the metal material M at the middle and upper parts in the vessel 21 is not limited to the method shown in the embodiment of making the cooling speed at the bottom faster than the cooling speeds at the middle and upper parts and is realized also by pouring the liquid-state metal material which later becomes a single semi-solidified metal into the vessel 21 divided into two or more parts.

Note that, the method exemplified in the embodiment and the method in the modification may be combined as well. Further, when dividing the pouring into two or more steps, the temperature of the vessel 21 rises due to the heat of the previously poured metal material M, therefore the cooling speed of the metal material M which is poured later is liable to become slower. Accordingly, the method of modification is accompanied by change of the cooling speed in many cases.

In the method of modification, an effect different from that in the embodiment is exerted. For example, after the rise of the solid phase rate of the previously poured metal material M, the load by all of the metal material M will be added to the bottom portion of the metal material M, therefore leakage of the metal material M from a slit between the hollow member 31 and the bottom member 33 is suppressed.

Example

A molding machine 101 (production apparatus 1) shown in the embodiment was actually fabricated, and producing the semi-solidified metal and molding of the molded article were executed. Measurement results of various temperatures and photographs of the metal material M in this example will be shown below. Note that, the solidus temperature of the metal material M in the example is about 555° C., and the liquidus temperature is 610 to 620° C.

Figure 8A:
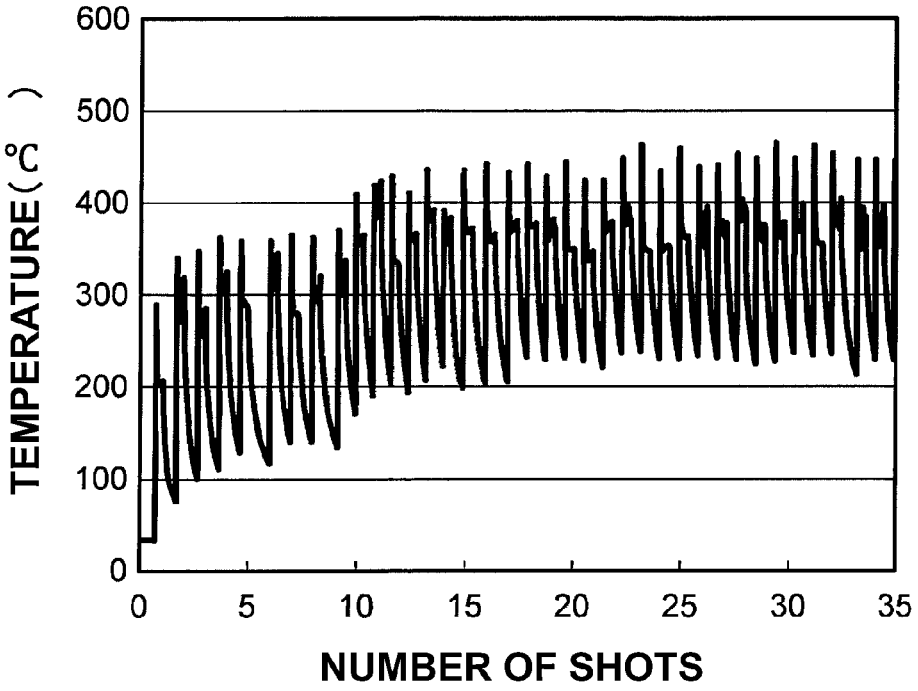
FIG. 8A and FIG. 8B are diagrams which show temperature changes of the vessel etc. in an example.

FIG. 8A is a diagram which shows the temperature change at the bottom of the vessel 21. The abscissa shows the time over a plurality of cycles (shots). The numbers attached to the abscissa show the numbers of shots. The ordinate shows the detection temperatures of the second temperature sensor 39 (FIG. 2).

The detection temperature of the second temperature sensor 39 roughly repeats the temperature fall due to the cooling of the auxiliary cooling device 37 before pouring and the temperature rise due to the pouring. The temperature near the maximum in each cycle may be roughly regarded as the temperature of the bottom portion of the metal material M in the vessel 21.

In this figure, roughly after 15 shots, the temperature change is stable. In this period, the maximum value of the temperature in each cycle has become about 420° C. It is seen that the temperature of the bottom portion of the metal material M has become sufficiently lower than the solidus temperature.

Figure 8B:
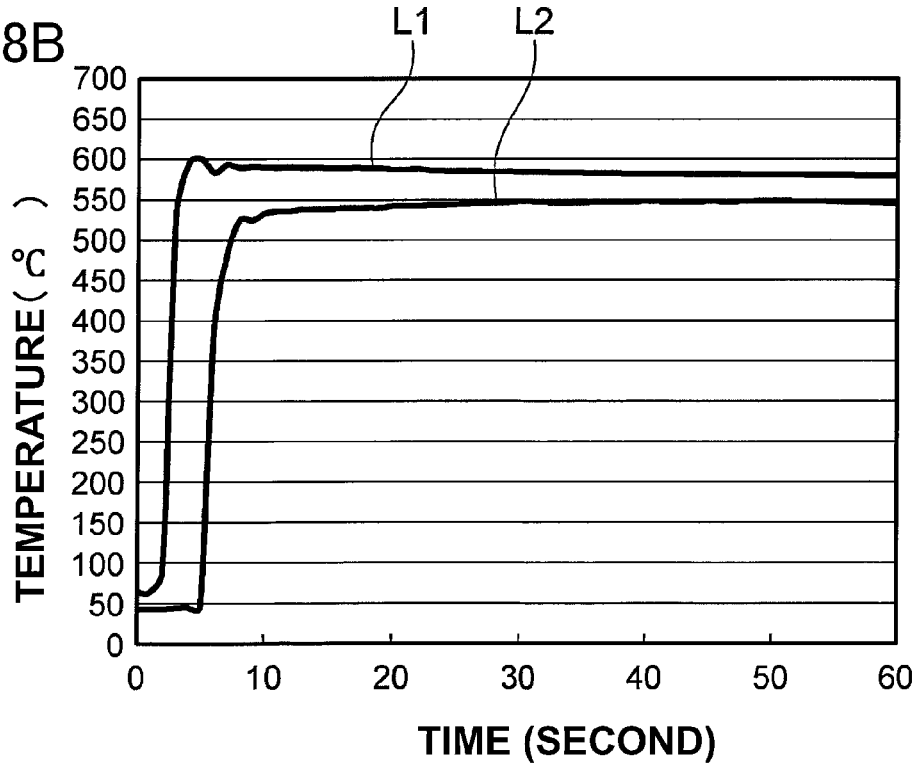

FIG. 8B is a diagram which shows a temperature change in the middle portions of the vessel 21 and metal material M. The abscissa shows the time (seconds) in one shot, and the ordinate shows the temperature. A line L1 shows the temperature of the middle portion of the metal material M (further the center portion when viewed on a plane), and a line L2 shows the temperature of the outer surface of the middle part of the vessel 21.

Note that, FIG. 8A shows the detection results of the second temperature sensor 39 provided in the production apparatus 1, therefore the measurement results are obtained over a large number of cycles. On the other hand, in FIG. 8B, a temperature sensor is arranged and the temperature is measured as an experiment, therefore only one shot's worth of the measurement result is shown. Note that, the measurement result in FIG. 8B is the result of a cycle in which the temperature change is sufficiently stabilized.

As shown in this diagram, in the middle portion of the metal material M, the temperature of the metal material M stagnates at a temperature larger than the solidus temperature, but lower than the liquidus temperature. That is, the temperature of the metal material M is stabilized in a temperature zone in which the semi-solidified metal is obtained.

Figure 9A:
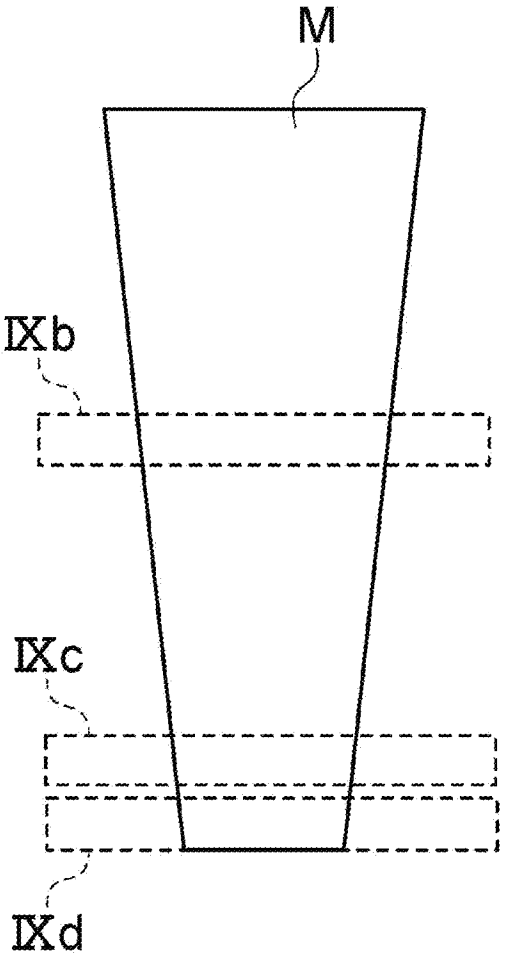
FIG. 9A is a schematic view of a semi-solidified state metal material.
Figure 9B:
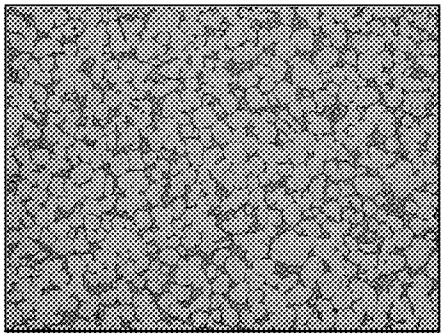
FIG. 9B to FIG. 9D are micrographs of cross-sections of the metal material in an example in regions IXb to IXd in FIG. 9A, and FIG. 9E to FIG. 9G are micrographs in a comparative example and correspond to FIG. 9B to FIG. 9D.
Figure 9C:
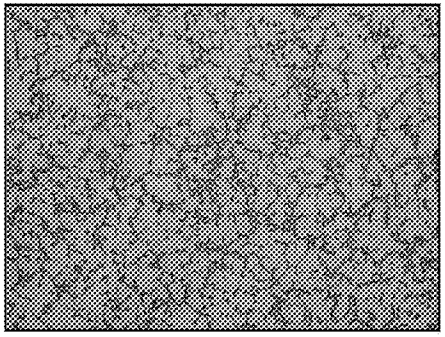
Figure 9D:
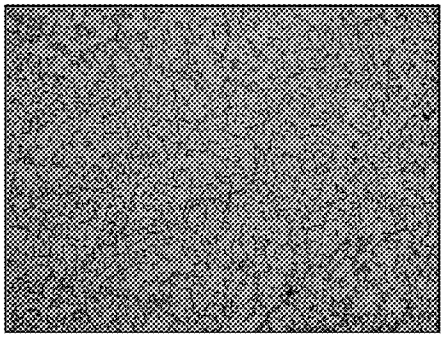

FIG. 9A is a schematic view of the semi-solidified state metal material M. FIG. 9B to FIG. 9D are micrographs of the cross-sections of the metal material M in regions IXb to IXd in FIG. 9A. That is, FIG. 9B, FIG. 9C, and FIG. 9D are micrographs of the middle portion, the portion right above the bottom portion, and the bottom portion of the semi-solidified state metal material M.

It was confirmed from these photographs that, in the example, the crystal was dendritic and fine in the bottom portion of the metal material M, and the crystal was granular in the middle portion. That is, due to the temperature gradient in the vessel 21, it was confirmed that a difference occurred in the structures of the middle portion and the bottom portion.

Figure 9E:
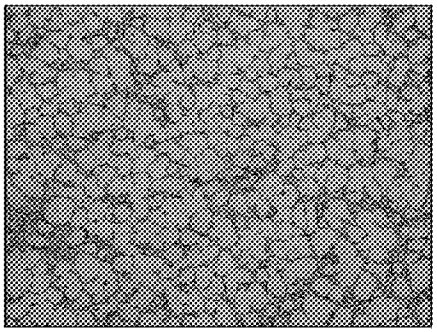
Figure 9F:
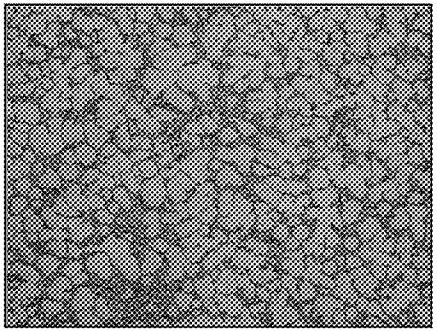
Figure 9G:
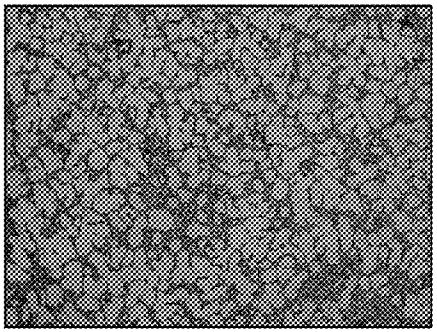

Note that, FIG. 9E to FIG. 9G are micrographs in a comparative example and correspond to FIG. 9B to FIG. 9D. In the comparative example, a configuration such as exemplified in the embodiment where the cooling speed becomes faster on the bottom portion side is not employed. That is, the temperature is basically constant over a portion from the upper part to the lower part of the vessel.

In the example and comparative example, there is almost no difference in the structure of the metal materials M in the middle portion. In contrast, in the bottom portion, a clear difference is recognized.

Figure 10A:
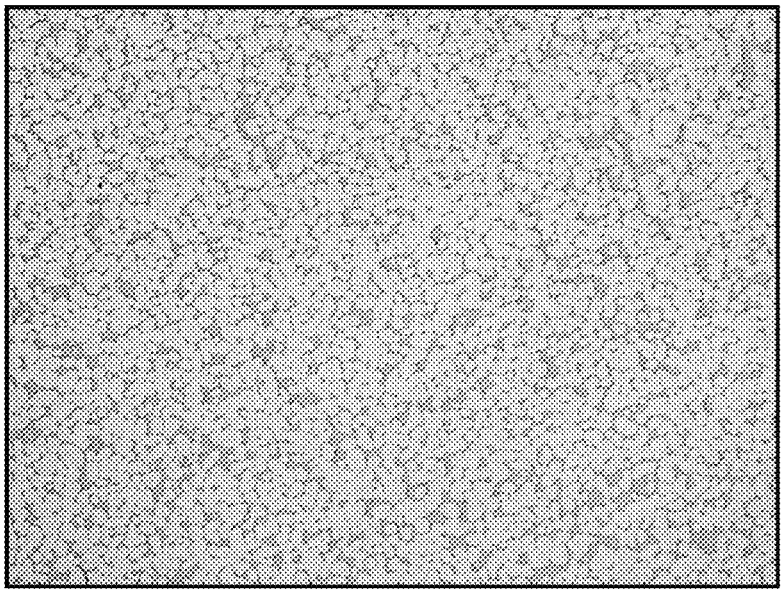
FIG. 10A and FIG. 10B are micrographs of cross-sections of the metal material in an example in regions Xa and Xb in FIG. 6.
Figure 10B:
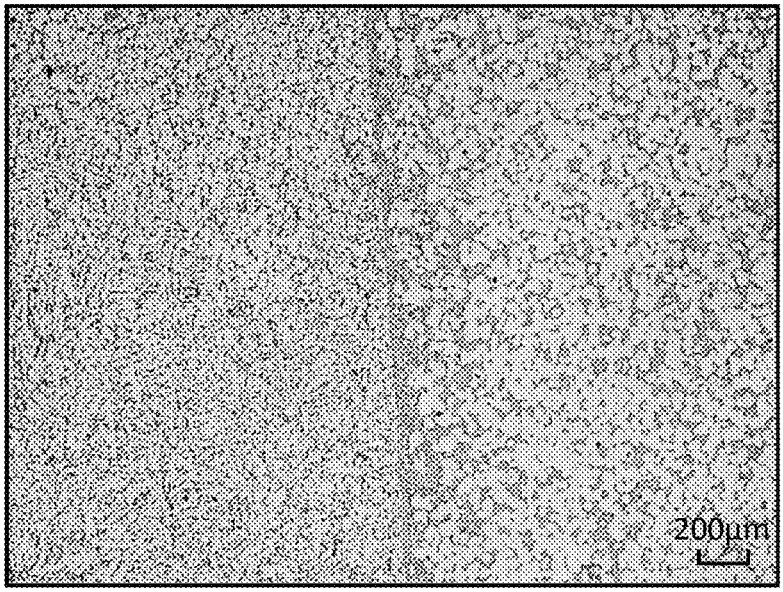

FIG. 10A and FIG. 10B are micrographs of the cross-sections of the metal material M in regions Xa and Xb in FIG. 6. That is, FIG. 10A is a micrograph of the product part, and FIG. 10B is a micrograph within a range including a portion which was the bottom portion of the metal material M in the vessel 21 in the biscuit.

First, it was confirmed from these diagrams that, in the product part, the crystal was granular and rough, and, in the biscuit, the crystal was dendritic and a fine portion was formed. Further, it was confirmed that, in the biscuit, a border line was generated between the portion which was the bottom portion of the metal material M in the vessel 21 and the portion other than this. The confirmed border line extends in a direction which is roughly along with the movement direction of the plunger 111.

Note that, in the above embodiment, the auxiliary cooling device 37 is one example of the cooling device, the piston rod 57 is one example of the pushing member, and the vessel-conveying device 27 is one example of the conveying device.

The present invention is not limited to the above embodiment and may be executed in various ways.

The production apparatus of the semi-solidified metal need not be a portion of the molding machine either. That is, the semi-solidified metal produced by the production apparatus need not be directly fed to the sleeve of the injection device, but may be quench-solidified and rendered the raw material (billet) of the semi-solidified metal.

The overall configuration of the production apparatus of semi-solidified metal is not limited to the configuration scooping out a liquid-state metal material from a holding furnace by a ladle and pouring this into the vessel. For example, a melting pot which melts one shot's worth of the metal material may be used in place of the holding furnace and ladle, and the metal material poured into the vessel by the melting pot as well. Further, for example, the liquid-state metal material may be poured from the holding furnace into the vessel through a suitable channel as well.

In the production of the semi-solidified metal, all processes do not have to be automatically carried out by the production apparatus. For example, at least one of the control of the heating device, the control of the pouring device, and the control of the semi-solidification device may be carried out by a worker as well. Further, for example, at least one of the heating, pouring, and cooling may be realized not according to facilities which are constructed enough to be called "apparatuses".

In the present embodiment, the semi-solidified metal was agitated by just pouring the liquid-state metal material into the vessel from a certain extent of height. However, an agitation device that causes motion of the vessel or an agitation device that causes motion of a member in the metal material may be provided. Further, in the present embodiment, no portion of the liquid phase part was discharged from the semi-solidified metal, but the part may be discharged.

The (second) temperature sensor arranged at the bottom member of the vessel need not be exposed in the vessel (need not abut against the metal material). For example, a thin portion may be formed in the bottom member, and the temperature sensor may be arranged to abut against the thin portion from the lower part as well.

The pre-cooling device need not be provided. The auxiliary cooling device may be one which cools the bottom member of the vessel from the outside (the channel for carrying the coolant may not be formed in the bottom member) or it may be possible to cool not only the bottom member, but also the hollow member. The coolant is not limited to water. For example, it may be another liquid (for example oil) or gas (for example air).

The method of pushing the bottom portion of the semi-solidified metal is not limited to the method of moving both of the vessel (semi-solidified metal) and pushing member and may be realized by movement of either.

The pushing device is not limited to one pushing the semi-solidified metal from the upper part to the lower part (of the absolute coordinate system) above the sleeve. For example, a relatively small hole may be formed in the bottom member 33, a pushing member which is capable of moving between the position of closing this hole and the position at which it projects upward from the former position may be provided, and this pushing member may be driven by an air cylinder provided in the setting device 25. In this case, the pushing device contributes to the semi-solidified metal being peeled off from the hollow member 31 and bottom member 33 and thereby make taking out of the semi-solidified metal from the hollow member 31 easier.

The pushing member may be used also for another purpose. For example, the pushing member may be a portion of the vessel as well. Specifically, as explained above, in the case where the hole of the bottom member is closed by the pushing member, the pushing member can be regarded as a portion of the vessel. Further, the inside diameter of the hollow member and the outside diameter of the bottom member may be made the same, and the entire bottom member may be utilized as the pushing member. A plunger for extruding the semi-solidified metal into the die may be utilized as the pushing member as well.

Note that, from the description of the present application, the following other inventions can be extracted.

(Other Invention 1)

A production apparatus of semi-solidified metal having:

a vessel cooling a liquid-state metal material which is poured from an upper opening and forming a semi-solidified metal, which vessel performs cooling of the metal material at a bottom prior to cooling of the metal material in middle and upper parts, and a pushing device pushing the bottom portion of the semi-solidified metal toward the upper opening.

(Other Invention 2)

A production apparatus of semi-solidified metal as set forth in other invention 1, further having a cooling device cooling the bottom of the vessel more than the periphery of the vessel.

(Other Invention 3)

A production apparatus of semi-solidified metal as set forth in other invention 1 or 2, wherein the bottom of the vessel is thicker than the periphery of the vessel.

(Other Invention 4)

A production apparatus of semi-solidified metal as set forth in any of other inventions 1 to 3, wherein a thermal conductivity of the bottom of the vessel is higher than a thermal conductivity of a periphery of the vessel.

(Other Invention 5)

A production apparatus of semi-solidified metal as set forth in any of other inventions 1 to 4, further having a pouring device pouring the liquid state metal material for later forms a single semi-solidified metal into the vessel divided into two or more times.

(Other Invention 6)

A production apparatus of semi-solidified metal as set forth in any of other inventions 1 to 5, wherein the pushing device makes the pushing member repeatedly strike the bottom portion of the single semi-solidified metal.

(Other Invention 7)

A production apparatus of semi-solidified metal as set forth in the other invention 6, further having a conveying device conveying at least a portion of the vessel, wherein the vessel has a hollow member which configures a wall section of the vessel and is opened at both of the upper and lower ends and a bottom member which closes the opening at the lower end of the hollow member and configures the bottom of the vessel, the pushing device makes the pushing member move back and forth, and the conveying device conveys the hollow member so as to separate the hollow member which holds the semi-solidified metal from the bottom member after the semi-solidified metal is formed in the vessel and then makes the lower opening of the hollow member approach the pushing member which is moving back and forth.

(Other Invention 8)

A molding apparatus having a production apparatus of semi-solidified metal as set forth in any of other inventions 1 to 7, a sleeve communicated with a die, and a plunger extruding the semi-solidified metal which is fed into the sleeve into the die, wherein the production apparatus of the semi-solidified metal feeds the semi-solidified metal to the sleeve so that the upper portion side of the semi-solidified metal is directed toward the die side and the bottom portion side of the semi-solidified metal is directed toward the plunger side.

(Other Invention 9)

A method of producing a semi-solidified metal having:

a formation step of pouring a liquid-state metal material into a vessel from an upper opening of the vessel and cooling the liquid-state metal material in the vessel to form a semi-solidified metal and a taking out step of taking out the semi-solidified metal from the vessel, wherein the formation step performs cooling of the metal material at a bottom of the vessel prior to the cooling of the metal material in middle and upper parts of the vessel and forms the semi-solidified metal so that a solid phase rate of the bottom portion becomes relatively high compared with the solid phase rates in the middle and upper parts, and the taking out step pushes the bottom portion of the semi-solidified metal toward the upper opening of the vessel and peels off the semi-solidified metal from the inner wall of the vessel.

(Other Invention 10)

A molding method having:

steps of the method of formation of the semi-solidified metal as set forth in other invention 9, a feeding step of feeding the semi-solidified metal to a sleeve which is communicated with a die, and an injection step of extruding the semi-solidified metal in the sleeve into the die by a plunger, wherein the feeding step feeds the semi-solidified metal to the sleeve so that an upper portion side of the semi-solidified metal is directed toward the die side and a bottom portion side of the semi-solidified metal is directed toward the plunger side.

(Other Invention 11)

A molding method as set forth in the other invention 10, wherein when filling the semi-solidified metal in the die by the injection step, the portion in the bottom portion of the semi-solidified metal, which has a high solid phase rate, is contained in a casting plan part.

In these other inventions, the vessel does not have to be able to be separated to the hollow member and the bottom member. As described above, it is also possible to make the pushing member abut against the semi-solidified metal from a hole formed in the bottom member. In this case, the hollow member and the bottom member do not always have to be able to be separated. Further, the method of performing cooling of the metal material at the bottom of the vessel prior to the cooling of the metal material in the middle and upper parts of the vessel includes various methods as exemplified in the embodiments and is not limited to the method of cooling the bottom member more than the hollow member. Accordingly, in other inventions, an auxiliary cooling device need not be provided.

Priority is claimed on Japanese application No. 2013-214110, filed Oct. 11, 2013, the content of which is incorporated herein by reference.

REFERENCE SIGNS LIST

1 . . . production apparatus, 21 . . . vessel, 29 . . . pushing device, 31 . . . hollow member, 33 . . . bottom member, 37 . . . auxiliary cooling device (cooling device), 101 . . . molding machine (molding apparatus), 103 . . . die, 109 . . . sleeve, 111 . . . plunger, and M . . . metal material.

The invention claimed is:

1. A molding apparatus comprising:

a sleeve which is communicated with a die, a production apparatus of a semi-solidified metal configured to feed the semi-solidified metal into the sleeve, and a plunger configured to push the semi-solidified metal which is fed into the sleeve into the die, wherein the production apparatus of the semi-solidified metal includes:

a vessel comprising:

a hollow member opened in up and down directions, and a bottom member removably coupled to the hollow member and configured to close a lower opening of the hollow member, a liquid-state metal material being poured into an upper opening of the hollow member, and a cooling device comprising a cooling part disposed only at the bottom member and not at the hollow member, the cooling device configured to cool the bottom member, and wherein the bottom member is wider than the lower opening of the hollow member.

2. A molding apparatus as set forth in claim 1, wherein:

the production apparatus of the semi-solidified metal is configured to feed the semi-solidified metal to the sleeve so that an upper portion side of the semi-solidified metal in the vessel is directed toward the die side and a bottom portion side of the semi-solidified metal in the vessel is directed toward the plunger side, and when the semi-solidified metal is filled in the die by the plunger, the portion in the bottom portion of the semi-solidified metal, which has a higher solid phase rate as compared to a remainder of the semi-solidified metal, is contained in the sleeve.

3. A molding apparatus as set forth in claim 1, wherein the production apparatus of the semi-solidified metal further includes a temperature sensor which is arranged in the bottom member.

4. A molding apparatus as set forth in claim 1, wherein the bottom member is thicker than the hollow member.

5. A molding apparatus as set forth in claim 1, wherein the production apparatus of the semi-solidified metal further includes a pushing device configured to push a bottom portion of the semi-solidified metal in the hollow member toward the upper opening of the hollow member.

6. A molding apparatus as set forth in claim 5, wherein the pushing device is configured to make a pushing member repeatedly strike the bottom portion of the semi-solidified metal.

7. A molding apparatus as set forth in claim 5, wherein:

the production apparatus of the semi-solidified metal further includes a conveying device conveying the hollow member, the pushing device is configured to make a pushing member move back and forth, and the conveying device is configured to convey the hollow member so as to separate the hollow member which holds the semi-solidified metal from the bottom member after the semi-solidified metal is formed in the vessel and then make the lower opening of the hollow member approach the pushing member which is moving back and forth.

8. A molding apparatus as set forth in claim 1, wherein the production apparatus of the semi-solidified metal further includes a pouring device configured to pour the liquid-state metal material which later forms a single semi-solidified metal into the vessel divided into two or more parts.

9. A molding apparatus as set forth in claim 1, wherein the cooling part is a channel for coolant.

10. A production apparatus of a semi-solidified metal comprising:

a vessel comprising:

a hollow member opened in up and down directions, and a bottom member removably coupled to the hollow member and configured to close a lower opening of the hollow member, a liquid-state metal material being poured into an upper opening of the hollow member, and a cooling device comprising a cooling part disposed only at the bottom member and not at the hollow member, the cooling device configured to cool the bottom member, and wherein the bottom member is wider than the lower opening of the hollow member.

* * * * *